US005344347A

United States Patent [19]

Inoue et al.

[11] Patent Number: 5,344,347

[45] Date of Patent: Sep. 6, 1994

[54] CONNECTOR DEVICE

[75] Inventors: Nori Inoue; Mitsuru Ito; Kiyofumi Ichida; Nobuyoshi Tanaka, all of Yokkaichi, Japan

[73] Assignee: Sumitomo Wiring Systems, Ltd., Yokkaichi, Japan

[21] Appl. No.: 119,832

[22] Filed: Sep. 13, 1993

[30] Foreign Application Priority Data

Sep. 29, 1992 [JP] Japan ..... 4-285494

[51] Int. Cl.[5] ..... H01R 13/502

[52] U.S. Cl. ..... 439/701; 439/924

[58] Field of Search ..... 439/677, 680, 686, 695, 439/701, 378, 924

[56] References Cited

U.S. PATENT DOCUMENTS 4,780,090 10/1988 Sugiyama et al. .

4,898,548 2/1990 Case et al. ..... 439/686

4,923,408 5/1990 Zinn ..... 439/686 X 4,963,098 10/1990 Myer et al. ..... 439/378 X 5,190,476 3/1993 Chaillot ..... 439/701 X

*Primary Examiner*—Khiem Nguyen

*Attorney, Agent, or Firm*—Oliff & Berridge

[57] ABSTRACT

A female connector housing is formed by arranging a fixed terminal holder so as to be fixed on an outer housing and arranging a movable terminal holder so as to be movable in a direction of insertion. The movable terminal holder is held with a front end thereof being ahead of the fixed terminal holder in the direction of insertion. Therefore, when the female connector housing is inserted into a male connector housing, a terminal group arranged on the movable terminal holder is first coupled, and a terminal group arranged on the fixed terminal holder is then coupled. In other words, all the terminals are coupled while divided into two groups at a single inserting stroke.

4 Claims, 9 Drawing Sheets

CONNECTOR DEVICE

BACKGROUND OF THE INVENTION

1. Field of the Invention

The invention relates to connectors for use in, e.g., wire harnesses or the like of vehicles, and more particularly to an improvement in reducing the inserting force involved in the coupling operation.

2. Description of the Related Art

Along with the growing number of circuits employed in automobiles in recent years, demanded as connectors used for wire harnesses are those of a multi-terminal structure. For instance, some high-grade passenger cars equipped with a power window system on the doors and electric devices such as various switches require a connector device with twenty or more terminals for connecting the door side to the car body side.

However, since the inserting force required for coupling male and female connectors together is substantially proportional to the number of terminals, multi-terminal connector devices require a large inserting force at the time of coupling. Multi-terminal connector devices make the inserting operation of connectors in assembling an automobile difficult and tend to increase incidence of defective connection attributable to incomplete insertion. To overcome these problems, various connector devices have recently been designed for reducing the inserting force.

An exemplary connector device is designed so that a lever mechanism is disposed between both connector housings of a connector device and that one of the connector housings is inserted into the other connector housing with a small inserting force utilizing the lever mechanism. However, this design is disadvantageous in that the connector device becomes large in entire structure since the lever mechanism is arranged separately.

Such an arrangement that a connector housing on the inserting side is divided into, e.g., two blocks is also proposed. According to such arrangement, it is ensured that the force of inserting each block will become one-half the force of inserting both blocks at once, thereby simplifying the operation of inserting the blocks. However, since the operation must be performed twice, the problem of increasing the steps in the process of assembling automobiles is in turn imposed.

SUMMARY OF THE INVENTION

The invention has been made in view of the above circumstances. Accordingly, the object of the invention is to provide a connector device which is capable of reducing the inserting force during the coupling operation without making the structure of the device large nor increasing the number of steps for coupling the connector device.

The invention is applied to a connector device, which includes: an outer housing, a fixed terminal holder, and a movable terminal holder on one of the connector housings. The fixed terminal holder has a plurality of terminals and is arranged within the outer housing so as to be fixed. The movable terminal holder has a plurality of terminals and is arranged so as to be movable in a direction in which the connector housing is inserted into the outer housing. The movable terminal holder is temporarily locked with the front end thereof being ahead of the fixed terminal holder in the connector housing insertion direction.

According to the above connector device, the movable terminal holder of one of the connector housings is temporarily locked with the front end thereof being ahead of the fixed terminal holder in the inserting direction. Therefore, when both connector housings are moved in the direction of insertion to allow them to be inserted, the terminal group arranged on the movable terminal holder is connected to the terminal group of the other connector housing. As a result, the inserting force at this point can be reduced to a significant degree over the inserting force entailed in the conventional structure in which all the terminals have to be connected at a single stroke.

The terminal group of the movable terminal holder has been connected. Since the movable terminal holder is arranged so as to be movable in the direction of insertion relative to the outer housing, the movable terminal holder and the outer housing slide relative to each other when the force acting in the direction of insertion is further applied to the outer housing. That is, the outer housing as well as the fixed terminal holder arranged so as to be fixed thereon move in the direction of insertion, so that the terminal group arranged on the fixed terminal holder is connected to the terminal group of the other connector housing. A reduction in the inserting force over the force involved in the conventional structure in which all the terminals have to be connected at a stroke is achieved also in this case.

As described above, the connector device of the invention is characterized as sequentially connecting all the terminals in groups. Therefore, the connector device of the invention contributes to reducing the required inserting force over that involved by the structure in which all the terminals are connected at a single stroke. Further, the respective terminal holders are arranged on the outer housing integrally, thereby allowing the coupling operation to be performed at a single inserting stroke, which contributes to not inviting an increase in the number of operation steps. Still further, no special mechanism such as a lever mechanism or the like is involved for connection, a compact structural design can be achieved.

DETAILED DESCRIPTION OF PREFERRED EMBODIMENTS

First Embodiment

A first embodiment of the invention will now be described with reference to FIGS. 1 to 10.

In this embodiment, a male connector housing 10 is mounted, e.g., on a door of a vehicle; and a female connector housing 20 is coupled while inserted into the male connector housing 10. This is a connector device of a multi-terminal type having twenty-five (25) terminals.

Figure 1:
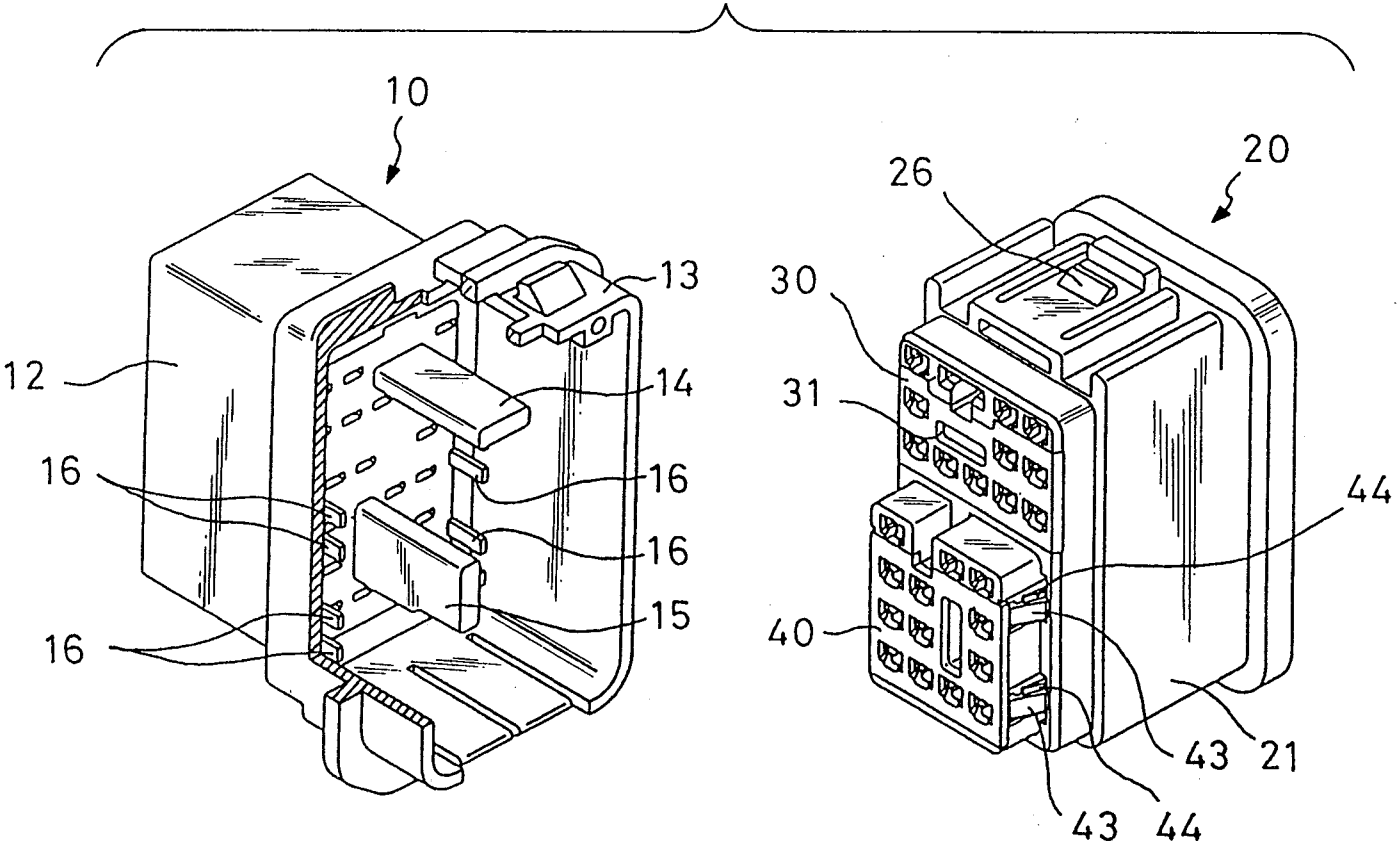
FIG. 1 is a perspective view of connector housings of a connector device, which is an embodiment of the invention.
Figure 4:
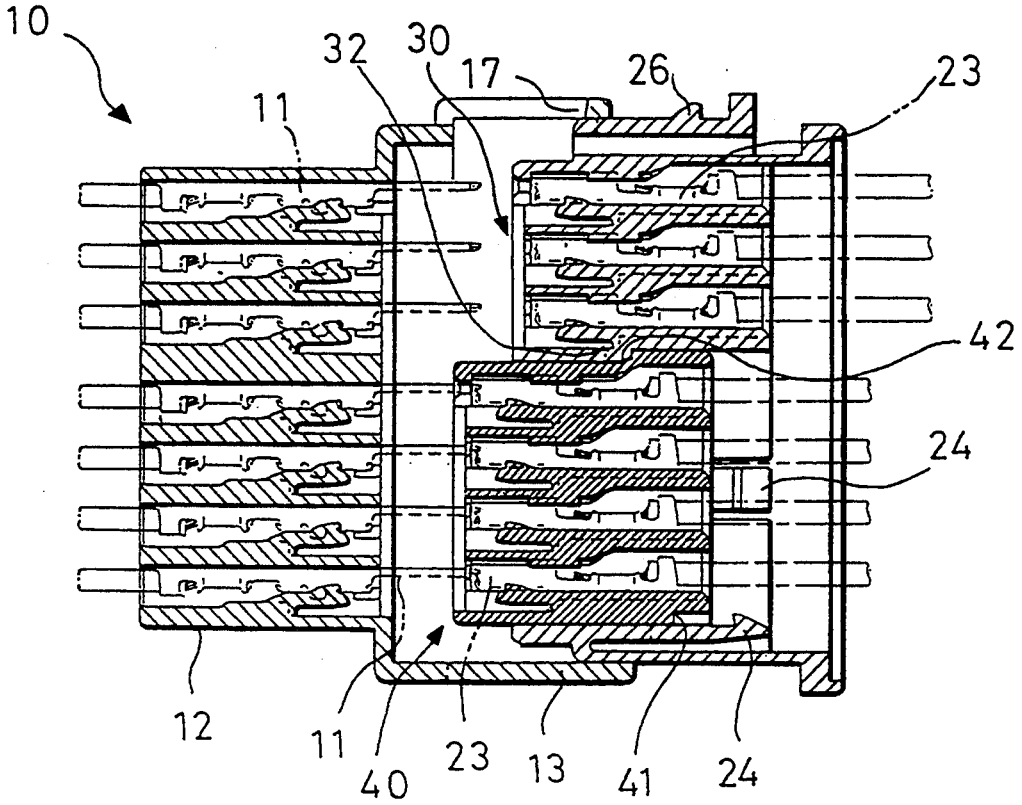
FIG. 4 is a longitudinal sectional view of the connector housings not coupled.

The male connector housing 10 has a terminal holding portion 12. The terminal holding portion 12 holds twenty-five (25) male terminals 11. A rectangular hood portion 13 is unitized with the male connector housing 10 so that the group of the male terminal 11 projecting from the terminal holding portion 12 can be covered therewith as shown in FIG. 4. Not only two erroneous insertion preventing pieces 14, 15 are formed integrally with the terminal holding portion 12 so as to project into the hood portion 13, but also four pairs of engagement releasing piece 16 for releasing a female connector housing 20 (described later) are arranged so as to project at a total of four positions in the lower half of the hood portion 13 as shown in FIG. 1. The respective pairs of engagement releasing pieces confront each other.

Figure 2:
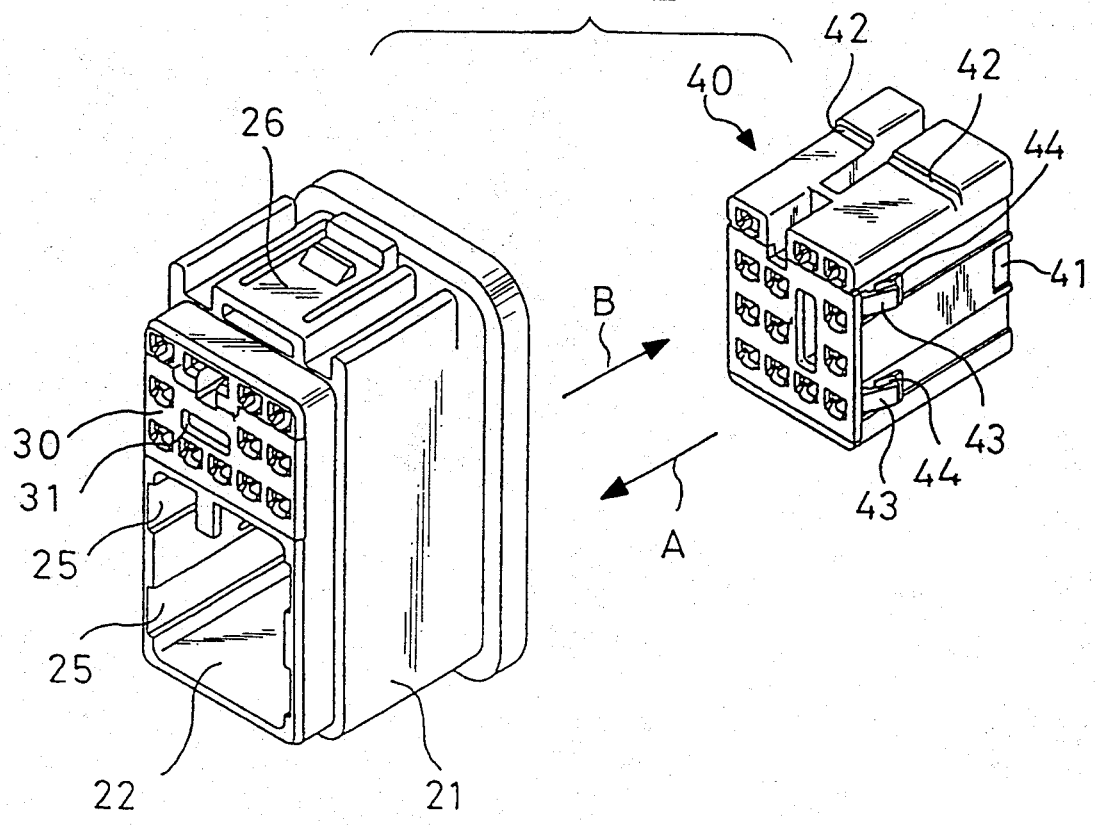
FIG. 2 is an exploded perspective view of a female connector housing of FIG. 1.

On the other hand, the female connector housing 20 has an outer housing 21 that is large enough to be inserted into the hood portion 13 of the male connector housing 10. The outer housing 21 is of a rectangular sleeve and, as shown in FIG. 2, is formed by unitizing a fixed terminal holer 30 in the upper half thereof and arranging a rectangular space 22 for receiving a movable terminal holder 40 (described later) in the lower half thereof. For example, eleven (11) female terminals 23 (see FIG. 4) are mounted to the fixed terminal holder 30 so as to be connected to the group of the male terminal 11. A through hole 31 for allowing the entrance of the erroneous insertion preventing piece 14 of the male connector housing 10 is formed at a predetermined position on the front surface of the insertion side.

The movable terminal holder 40 is molded so as to be a body separate from the outer housing 21 and is received by the receiving space 22 of the outer housing 21 so as to be slidably movable in the direction of inserting and extracting the female connector housing 20. Inside this movable terminal holder 40 is a total of thirteen (13) female terminals mounted, so that these thirteen female terminals can be connected to the thirteen male terminals 11 that remain unconnected out of the group of the male terminal 11 of the male connector housing 10 after the 11 male terminals have been connected to the group of the female terminal 23 mounted on the fixed terminal holder 30.

As shown in FIG. 4, a total of three (3) hooks 24 for preventing the coming out of the terminals are formed so as to be resiliently deformable on the bottom portion of and both left and right sides of the receiving space 22 in the outer housing 21. In correspondence with these hooks 24, engaging recessed portions 41 are formed (FIG. 2 shows the engaging recessed portion 41 only on the side surface). Therefore, when the movable terminal holder 40 is inserted into the receiving space 22 in a direction of arrow A from the rear side, the hooks 24 permit entrance of the movable terminal holder 40 while deformed resiliently and return to positions shown in FIG. 4 after the movable terminal holder 40 has passed through, so that the hooks 24 accommodate the engaging recessed portions 41. As a result, the movable terminal holder 40 is regulated so as not to move backward (the direction of arrow B), which is a condition in which the movable terminal holder 40 is prevented from coming out.

Further, as shown in FIG. 2, stepped portions 42 whose rear side is erected are formed on the upper surface of the movable terminal holder 40, whereas, as shown in FIG. 4, a locking stepped portion 32 whose front side is erected is formed on the lower surface of the fixed terminal holder 30. Therefore, as shown in FIG. 4, the stepped portions 42 of the movable terminal holder 40 are held by the locking stepped portion 32 of the fixed terminal holder 30 with the movable terminal holder 40 being received by the receiving space 22 of the outer housing 21, thereby regulating the movement of the movable terminal holder 40 in the frontward direction to prevent the movable terminal holder 40 from projecting through.

Still further, a total of four (4) locking hooks 43 are arranged on the left and right sides of the front end of the movable terminal holder 40. Each locking hook 43 is resiliently deformable in such a manner that the rear end thereof move away from the movable terminal holder 40. When the movable terminal holder 40 is received by the receiving space 22 of the outer housing 21 from the rear side, the locking hooks 43 pass through grooves 25 formed on the inner wall of the receiving space 22 while resiliently deformed. When the front end of the movable terminal holder 40 projects from the receiving space 22, the locking hooks 43 resiliently return and come in contact with the peripheral edge of the front end of the outer housing 21. Accordingly, the movable terminal holder 40 is temporarily locked by the outer housing 21 with the front end of the movable terminal holder 40 being ahead of the fixed terminal holder 30 in the direction of insertion as shown in FIG. 1.

Figure 3A:
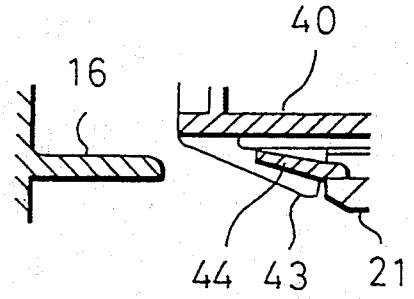
FIGS 3A, 3B, 3C are enlarged sectional views of a locking hook.

Auxiliary projections 44 are formed on both sides of the locking hook 43. Each auxiliary projection 44 is retreated one step from the surface of the locking hook 43 as shown in FIG. 3, and corresponds with each of engagement releasing piece 16 of the male connector housing 10. When the female connector housing 20 is fully inserted into the hood portion 13 of the male connector housing 10, the paired engagement releasing pieces 16 abut against the auxiliary projections 44 positioned on both sides of the locking hook 43.

Figure 5:
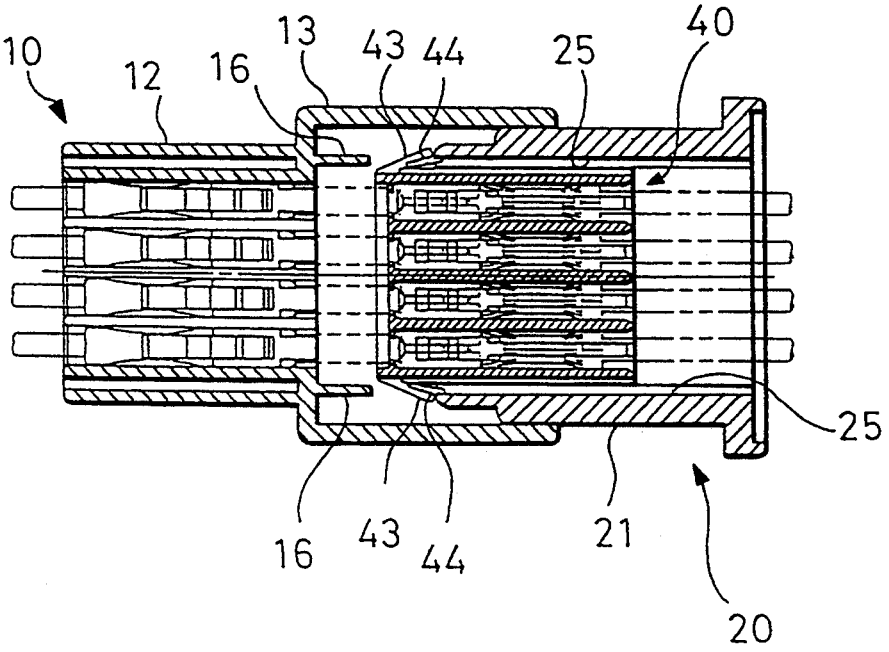
FIG. 5 is a horizontal sectional view of the connector housings not coupled.

In the above-described arrangement, the connector is connected in the following way. In connecting the connector, the movable terminal holder 40 of the female connector housing 20 is in such a condition that the front end of the movable terminal holder 40 is ahead of the fixed terminal holder 30 in the direction of insertion as shown in FIG. 1. Under this condition, the outer housing 21 of the female connector housing 20 is held by a hand and is inserted into the hood portion 13 of the male connector housing 10 (see FIGS. 4 and 5). As a result, the group of the female terminal 23 held by the movable terminal holder 40 starts being connected to the group of the male terminal 11 of the male connector housing 10 as shown in FIGS. 4 and 5, which increases insertion resistance. However, since the number of female terminals 23 that start being connected at this stage is only 13, which is substantially one-half the total number, the insertion resistance is not so excessively large that the terminals can be inserted without difficulty. The movable terminal holder 40 receives such a force as to move rearward relative to the outer housing 21 by the insertion resistance. However, since the locking hooks 43 arranged on the movable terminal holder 40 are in a locking condition while abutted on the front end surface of the outer housing 21 at this stage as shown in FIG. 5, the movement of the movable terminal holder 40 is regulated so as to prevent itself from escaping rearward.

Figure 3B:
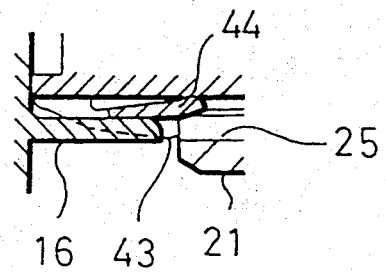
Figure 6:
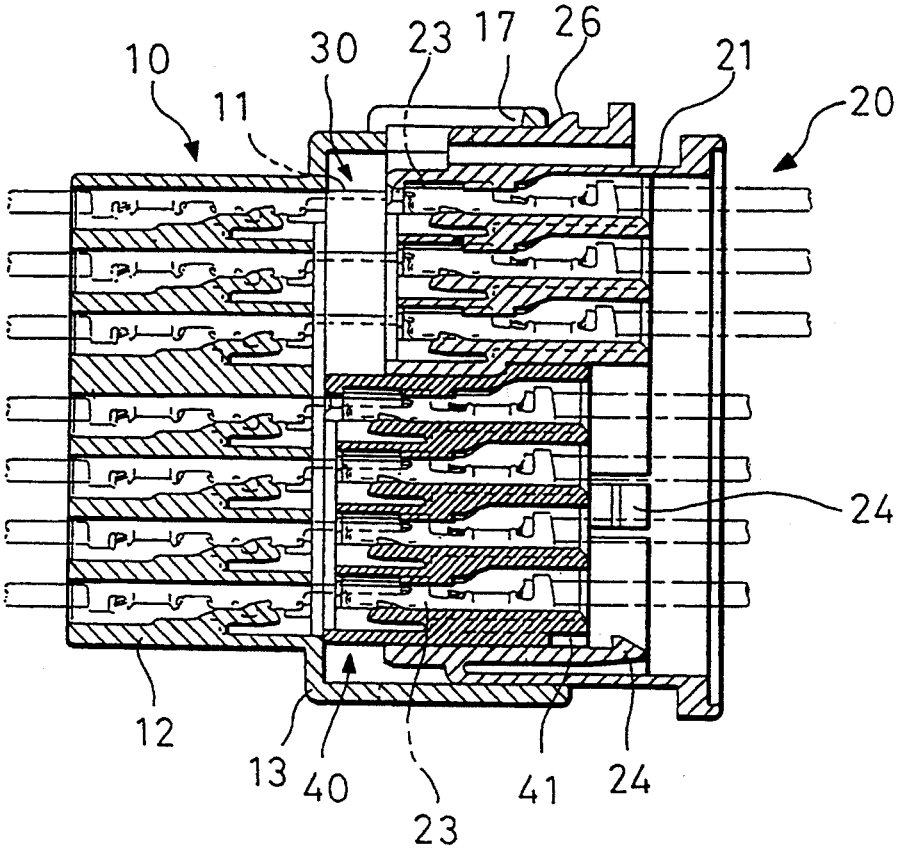
FIG. 6 is a longitudinal sectional view of the connector housings in the course of being coupled.
Figure 7:
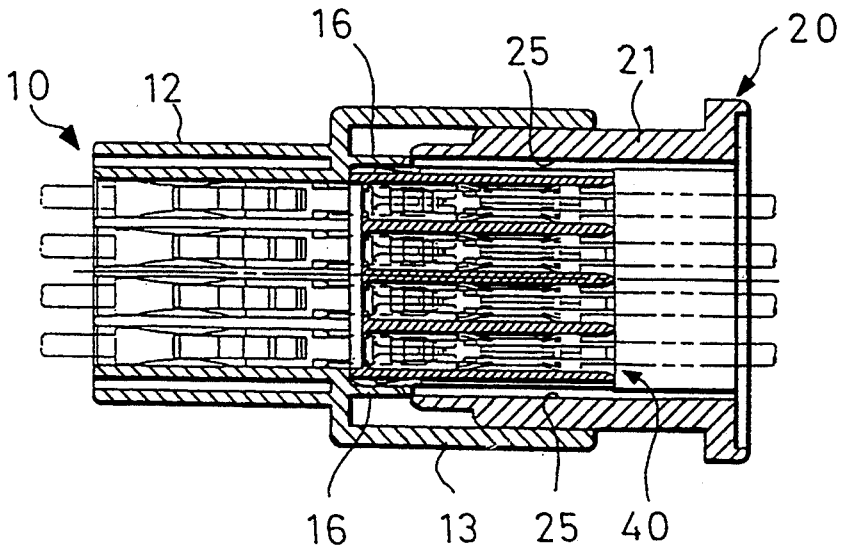
FIG. 7 is a horizontal sectional view of the connector housings in the course of being coupled.

When the movable terminal holder 40 has been inserted to such an extent that the holder 40 abuts against the depth of the hood portion 13, the coupling of the group of the female terminal 23 of the movable terminal holder 40 is completed as shown in FIGS. 6 and 7. Under this condition, the engagement releasing pieces 16 arranged on the male connector housing 10 bias the auxiliary projections 44 arranged on the locking hooks 43 of the movable terminal holder 40 as shown in FIG. 3B. Then, the locking hooks 43 deform resiliently along the side surfaces of the movable terminal holder 40, releasing the locking condition relative to the outer housing 21. As a result, the movable terminal holder 40 and the outer housing 21 can move slidably relative to each other.

Figure 3C:
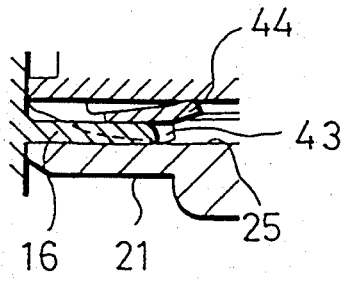
Figure 8:
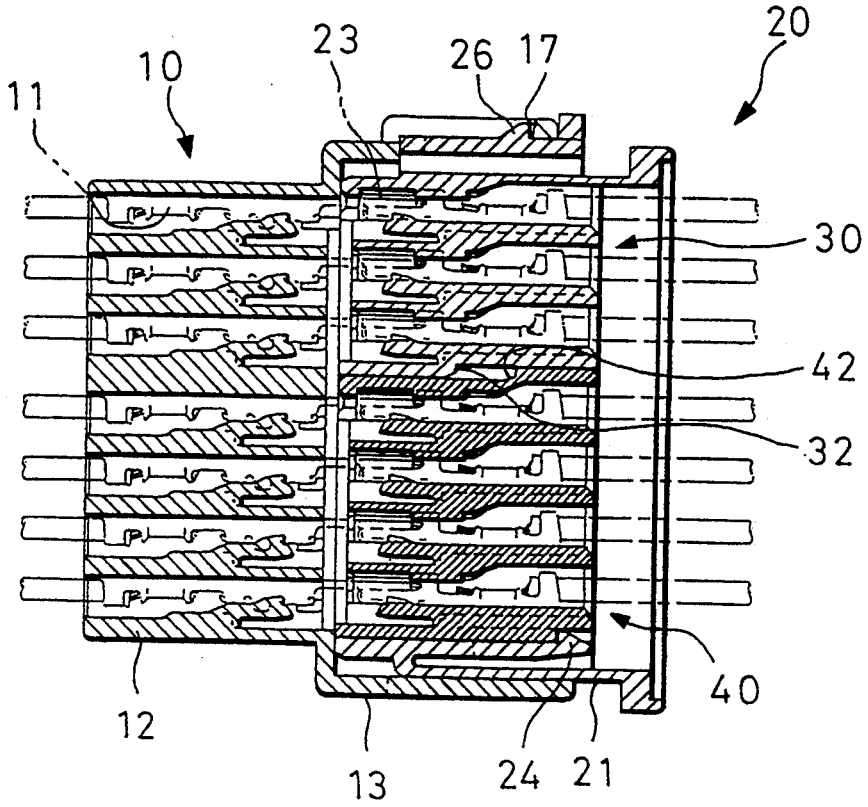
FIG. 8 is a longitudinal sectional view of the connector housings having been coupled.
Figure 9:
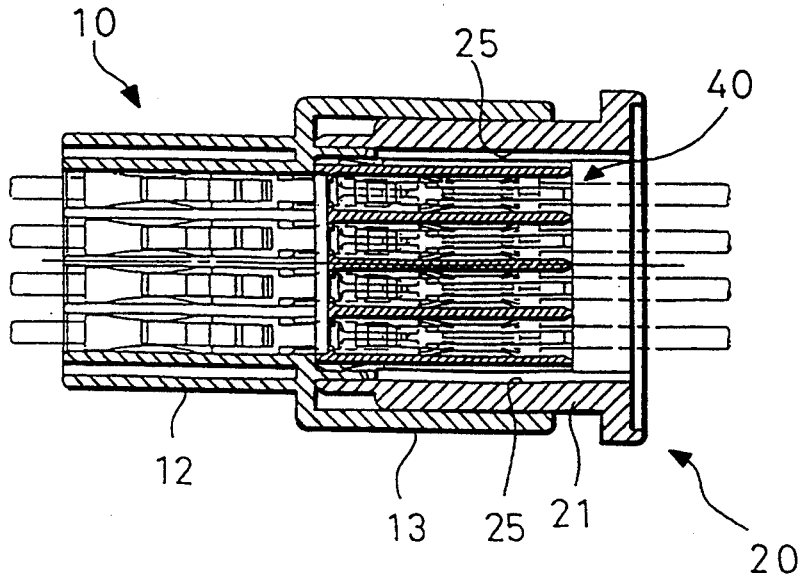
FIG. 9 is a horizontal sectional view of the connector housings having been coupled.
Figure 10:
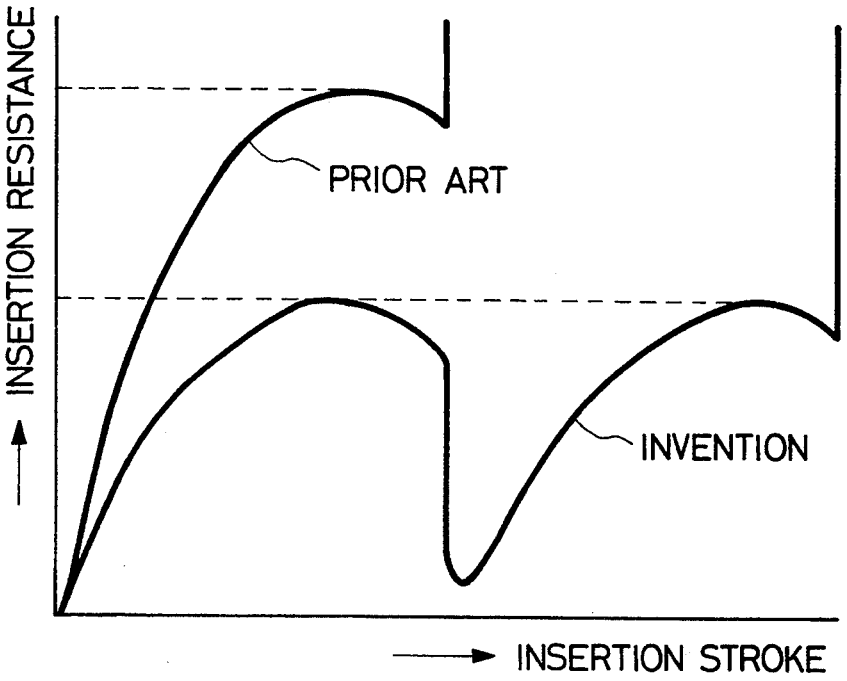
FIG. 10 is a graph showing variations of an insertion resistance.

Thus, as the outer housing 21 is further pushed in the direction of insertion, the outer housing 21 and the fixed terminal holder 30 unitized therewith advance into the depth of the hood portion 13, causing the group of the female terminal 23 mounted on the fixed terminal holder 30 to be coupled to the group of the remaining male terminal 11 of the male connector housing 10. As a result, the insertion resistance increases again as these terminals are connected. However, since the number of terminals is only 12, which is substantially one-half the total, the insertion resistance does not become so excessively large that both terminals can be inserted with a small force. When the fixed terminal holder 30 has been inserted to such an extent as to abut against the depth of the hood portion 13, the coupling of the group of the female terminal 23 of the fixed terminal holder 30 is also completed as shown in FIGS. 8 and 9. As a result, an engaging hook 26 arranged on the outer housing 21 of the female connector housing 20 is engaged with an engaging hole 17 arranged on the hood portion 13 of the male connector housing 10, thereby locking the coupling between both connector housings 10 and 20. Under this condition, the engagement releasing pieces 16 arranged on the male connector housing 10 are positioned inside the grooves 25 of the outer housing 21 as shown in FIG. 3C.

According to this embodiment, when the female connector housing 20 is inserted into the hood portion 13 of the male connector housing 10 by holding the former in a hand, first, the group of the female terminal 23 arranged on the movable terminal holder 40 is coupled to the group of the corresponding male terminal 11, and, then, the group of the female terminal 23 arranged on the fixed terminal holder 30 is coupled to the group of the remaining male terminal 11. That is, the total terminals are coupled while divided into two groups half-and-half, which makes the insertion resistance in each turn about one-half the insertion resistance conventionally required for coupling the total terminals in one turn, thereby allowing the connecting operation to be performed with a small inserting force. Therefore, the operation of inserting the connector is facilitated, and defective connection attributable to incomplete insertion can be prevented. Variations in insertion resistance of the connector device, which is this embodiment, are as shown by a solid line in FIG. 10. It is apparent that the maximum insertion resistance is substantially one-half the insertion resistance of the conventional multi-terminal connector shown by a broken line.

In addition, the fixed terminal holder 30 and the movable terminal holder 40 are arranged integrally with the outer housing 21 in this embodiment, which means that these holders can be handled integrally. Therefore, in a manner similar to the conventional integrated connector device, the terminals can be inserted at a single stroke, thus not increasing the number of process steps. Since the connector device involves no special mechanism such as a lever mechanism or the like for the connection of the connector housings, the general structure thereof can, of course, be compact.

Second Embodiment

Figure 11:
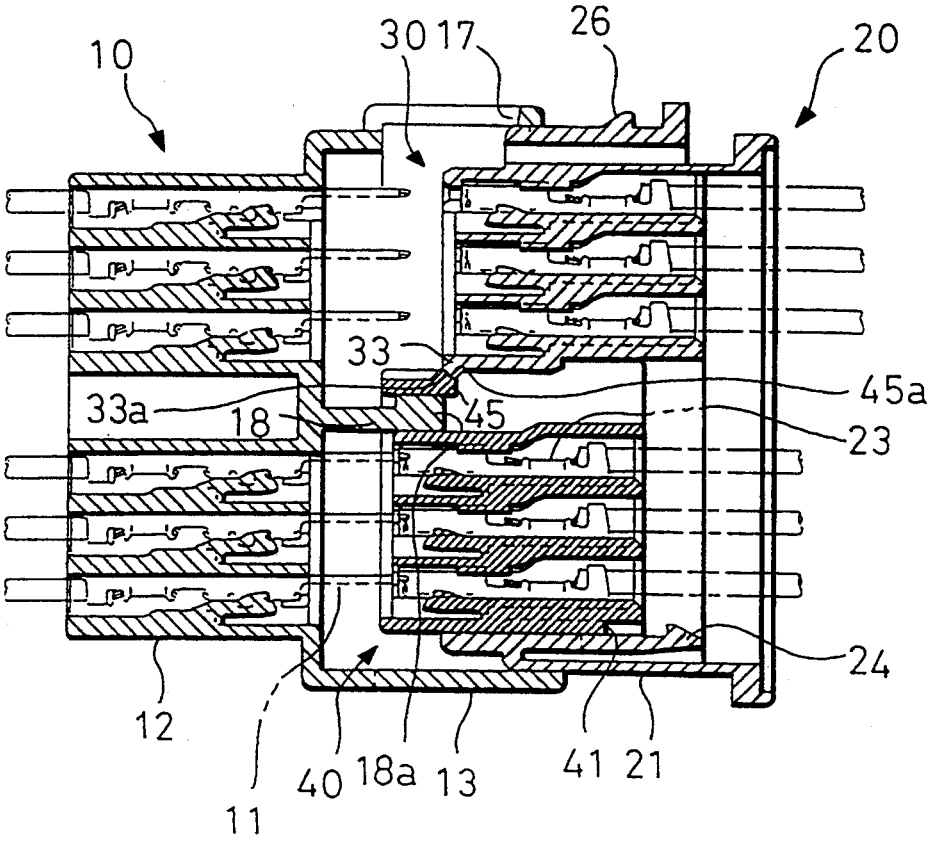
FIG. 11 is a longitudinal sectional view of connector housings of a connector device, which is a second embodiment of the invention, the connector housings not coupled.
Figure 12:
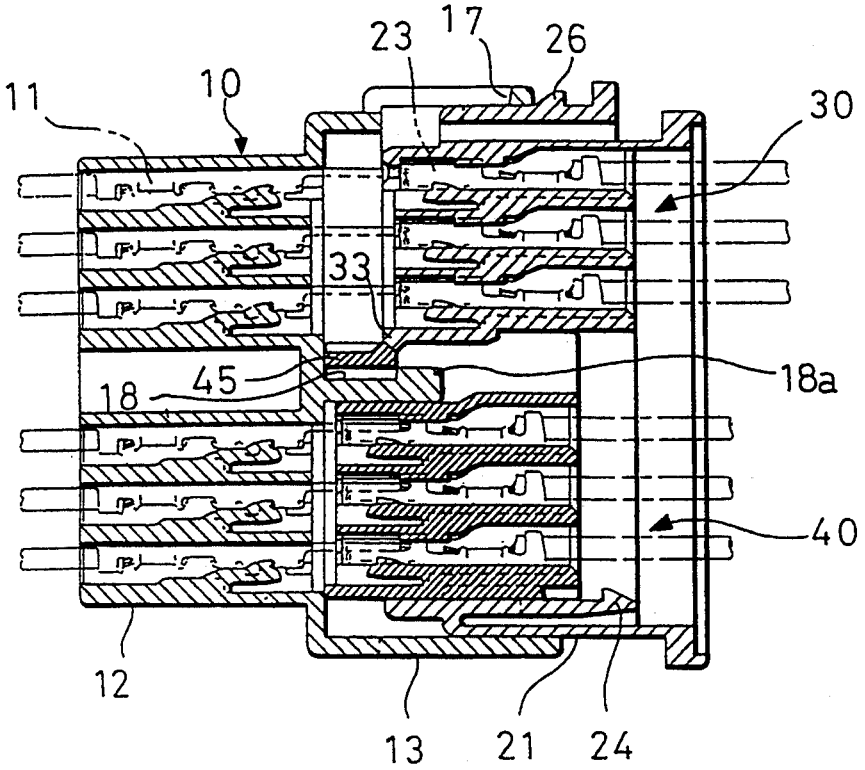
FIG. 12 is a longitudinal sectional view of the connector housings of FIG. 11 in the course of being coupled.
Figure 13:
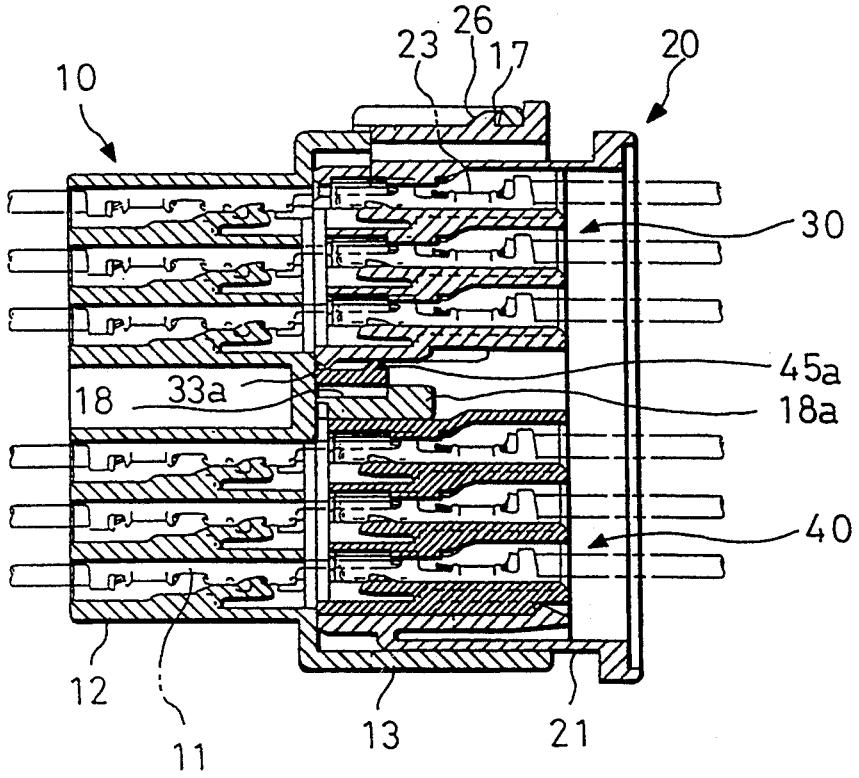
FIG. 13 is a longitudinal sectional view of the connector housings of FIG. 11 having been coupled.

FIGS. 11 to 13 show a second embodiment of the invention. The second embodiment differs from the first embodiment in the means for locking the movable terminal holder 40 relative to the outer housing 21, with the other aspects being similar. Therefore, the parts and components of the second embodiment which are the same as those of the first embodiment will be designated by the same reference characters and the description thereof will be omitted to avoid repetition; it is only differences that will be described.

A locking piece 45 that is resiliently deformable is integrally molded on an upper surface of the movable terminal holder 40 of the female connector housing 20, and a locking surface **45*a* inclined obliquely rearward is formed on a rear end surface of the locking piece 45. On the other hand, a locking projection 33 having a locking surface 33*a* is arranged on a lower surface of the fixed terminal holder 30, so that the locking surfaces 33*a*, 45*a* can be abuttable against each other. The locking surface 33*a* is inclined obliquely frontward. When these locking surfaces 33*a*, 45*a* have been abutted against each other, the movable terminal holder 40 gets held with the front end thereof being ahead of the fixed terminal holder 30 in the direction of insertion of the female connector housing 20. A hold auxiliary projection 18 whose front end is thickened to form a backup portion 18*a* is provided substantially in the middle of the male connector housing 10. The backup portion 18*a* can enter the lower surface of the locking piece 45**.

When the male connector housing 20 is inserted into the hood portion 13 of the male connector housing 10 in order to couple both connector housings 10, 20 under this arrangement, the backup portion 18*a* of the hold auxiliary projection 18 first advances to the lower portion of the locking piece 45 of the movable terminal holder 40 as shown in FIG. 11. As a result, the resilient deformation of the locking piece 45 is regulated, so that a large frictional force between the locking surface 45*a* of the locking piece 45 and the locking surface 33*a* of the fixed terminal holder 30 is ensured. Therefore, even if a relatively large insertion resistance is caused after the coupling between the group of the male terminal 11 and the group of the female terminal 23 has been started as the insertion of the female connector housing 20 progresses, both terminal groups can be connected completely without causing the movable terminal holder 40 to retreat backward. It goes without saying that the inserting operation can be performed easily without making the insertion resistance too large also in the second embodiment, since the number of female terminals 23 with which the connecting operation is started is only 13, which is almost one-half the total number of female terminals.

When the movable terminal holder 40 has been inserted to such an extent that the movable terminal holder 40 abuts against the depth of the hood portion 13, the connection of the group of the female terminal 23 of the movable terminal holder 40 is completed as shown in FIG. 12. Under this condition, it is apparent from FIG. 12 that the backup portion 18*a* of the hold auxiliary projection 18 which is arranged on the male connector housing 10 is ready to be released from the contact thereof with the locking piece 45 of the movable terminal holder 40. As a result, the resilient deformation of the locking piece 45 is allowed.

When the outer housing 21 is further pushed in the inserting direction, the locking piece 45 of the movable terminal holder 40 gets resiliently deformed while biased by the locking projection 33 of the fixed terminal holder 30, allowing the outer housing 21 and the fixed terminal holder 30 unitized therewith to advance deeper into the hood portion 13. In the end, coupling between the group of the female terminal 23 mounted on the fixed terminal holder 30 and the group of the remaining male terminal 11 of the male connector housing 10 is started. While the insertion resistance increases again as these terminal groups are being coupled, the insertion resistance does not grow too large a value because the number of terminal groups is only 12, which is about one-half the total. This means that the inserting operation can be performed again with a small force. When the fixed terminal holder 30 is inserted to such an extent that the fixed terminal holder 30 abuts against the depth of the hood portion 13, the coupling of the group of the female terminal 23 of the fixed terminal holder 30 is completed as shown in FIG. 13, holding the coupling between both connector housings 10, 20 with the engaging hook 26 arranged on the outer housing 21 of the female connector housing 20 engaged with the engaging hole 17 arranged on the hood portion 13 of the male connector housing 10.

Since the total terminals are coupled half-and-half while divided into two groups also in the second embodiment in a manner similar to the first embodiment, only a small force is required for insertion. As a result, not only the inserting operation becomes easy, but also defective connection due to incomplete insertion can be prevented. Further, similar to the ordinary integrated connector device, the connector housings of the connector device of the invention can be connected completely at a single stroke, and can be formed into a compact structure.

Third Embodiment

Figure 14:
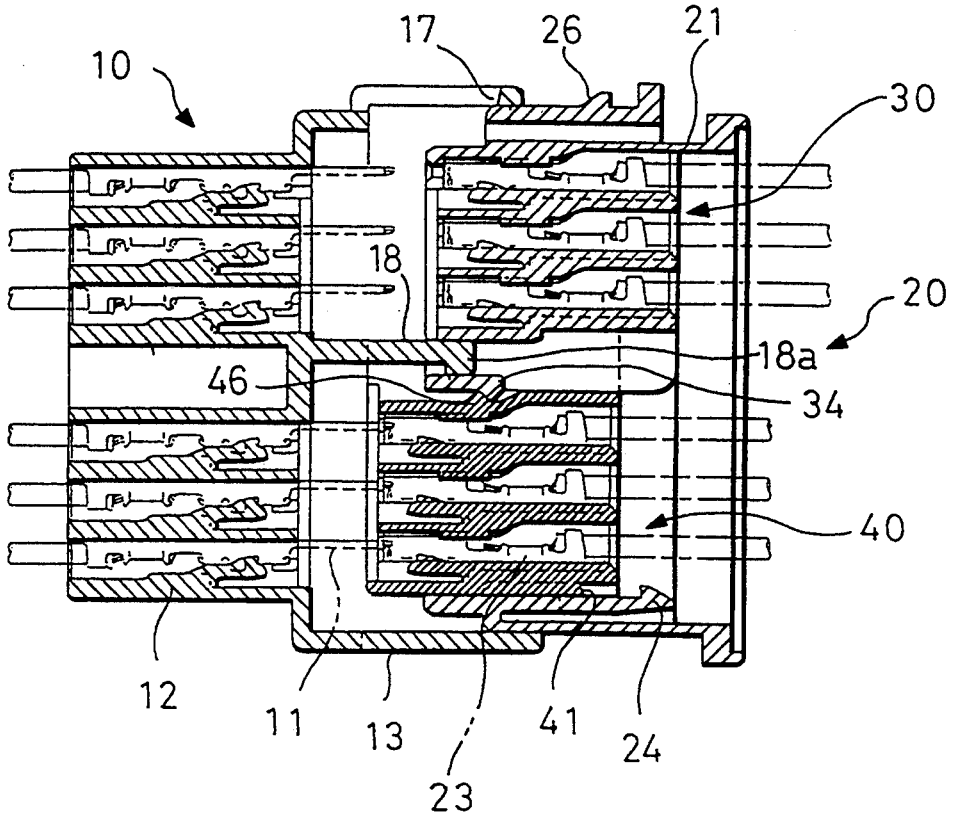
FIG. 14 is a longitudinal sectional view of connector housings of a connector device, which is a third embodiment of the invention, the connector housings not coupled.
Figure 15:
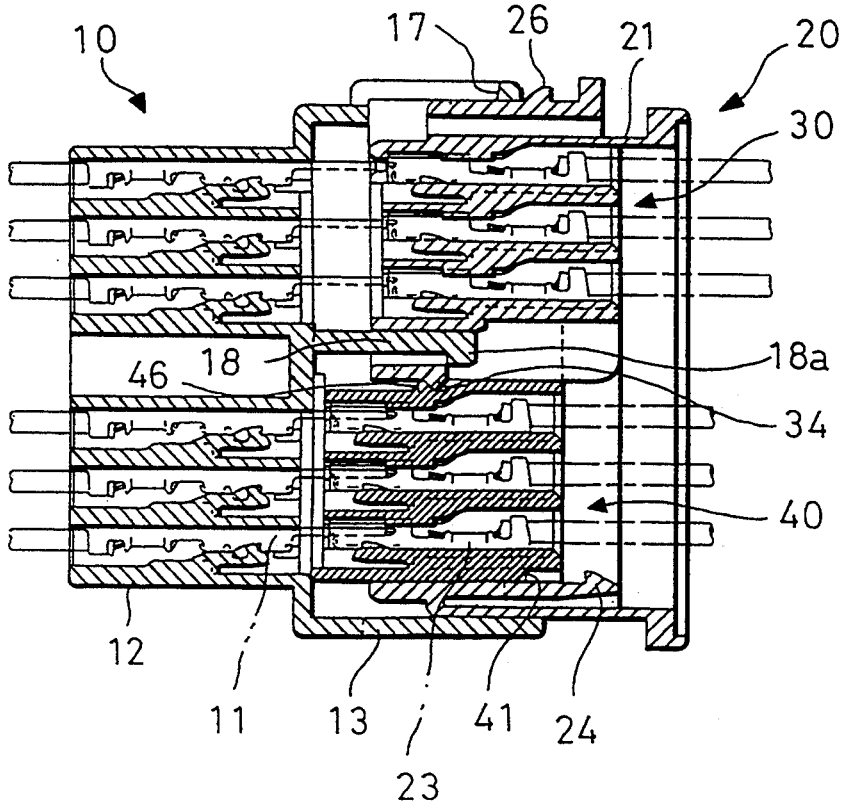
FIG. 15 is a longitudinal sectional view of the connector housings of FIG. 14 in the course of being coupled.
Figure 16:
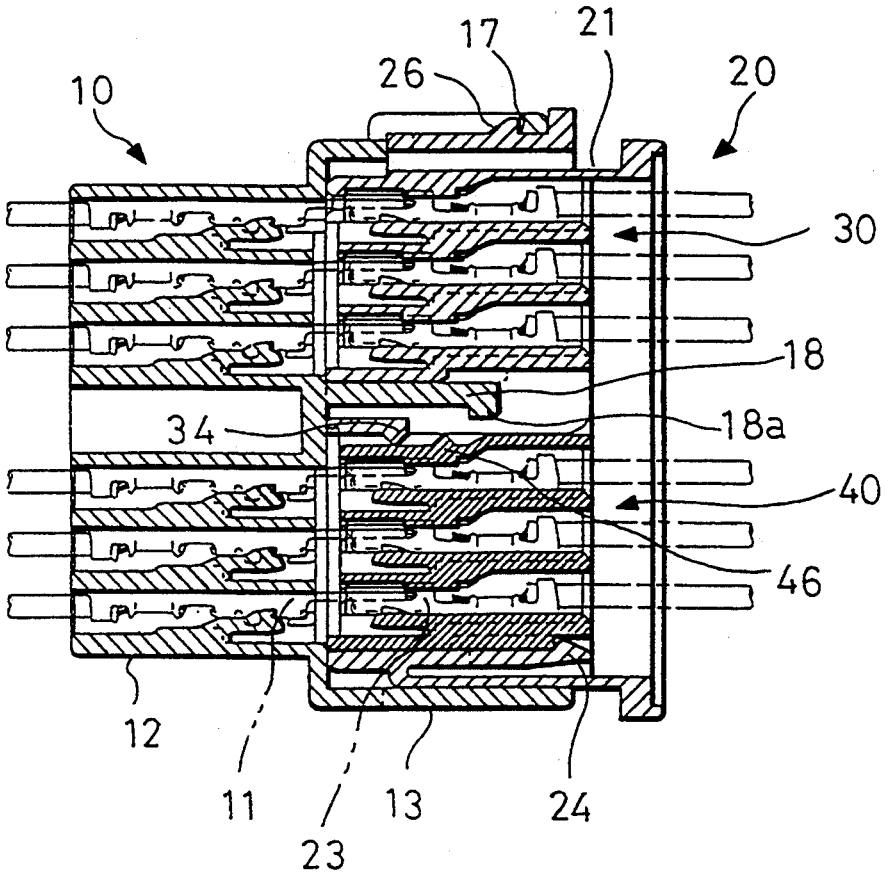
FIG. 16 is a longitudinal sectional view of the connector housings of FIG. 14 having been coupled.

FIGS. 14 to 16 show a third embodiment of the invention. The third embodiment differs from the first and second embodiments in the locking means of the movable terminal holder 40, with the other aspects being similar. Therefore, the parts and components of the third embodiment which are the same as those of the first embodiment will be designated by the same reference characters and the description thereof will be omitted to avoid repetition; it is only differences that will be described.

Unlike the second embodiment, the third embodiment is characterized as forming a resiliently deformable locking piece 34 on a fixed terminal holder 30 and forming a locking projection 46 corresponding therewith on the upper surface of the movable terminal holder 40. While the hold auxiliary projection 18 is similarly arranged on the male connector housing 10, the backup portion 18*a* thereof faces downward so as to correspond with the locking piece 34 of the fixed terminal holder 30.

In such arrangement, the backup portion 18*a* of the hold auxiliary projection 18 is in contact with the locking piece 34 under the uncoupled condition as shown in FIG. 14, maintaining the locking condition between the locking projection 46 and the locking piece 34 while regulating the resilient deformation of the locking piece 34. As a result, the escaping movement of the movable terminal holder 40 associated with the connection of the terminal groups is blocked. Under the condition shown in FIG. 15, in which the connection of the group of the female terminal 23 mounted on the movable terminal holder 40 has been completed, the backup portion 18*a* of the hold auxiliary projection 18 is released from the contact with the locking piece 34, thereby allowing the locking piece 34 to be resiliently deformed. In addition, when the fixed terminal holder 30 has been inserted, the fixed terminal holder 30 advances further into the depth of the hood portion 13. As a result, the terminal group is coupled in two turns, thereby making the maximum insertion resistance substantially half the conventional value. Likewise the ordinary integrated connector device, the connection in the third embodiment of the invention can, of course, be completed at a single stroke. In addition, the entire structure can be made compact as in the other embodiments of the invention.

The embodiments of the invention are not limited to those described above, but may include such as follows.

(a) The above embodiments are designed so that the temporary hold condition of the movable terminal holder 40 is automatically released after the coupling of the terminal group on the movable terminal holder 40 has been completed. However, the invention may also be applied to such an arrangement in which, e.g., a hold releasing button is arranged on the outer housing so that the temporary hold condition of the movable terminal holder can be released by pressing the hold releasing button when the coupling of the terminal group on the movable terminal holder has been completed. Further, without involving any special hold releasing mechanism, it may be so designed that, e.g., the movable terminal holder is temporarily locked by frictional force between a resiliently deformable locking piece and a locking projection corresponding therewith so that the static friction force is set so as to become larger than the insertion resistance at the time the terminal group mounted on the movable terminal holder is coupled. This can be achieved by, e.g., such a design that the hold auxiliary projection 18 is omitted and that the rigidity of the locking piece 45 of the movable terminal holder 40 is set to a large value in the second embodiment.

(b) While the above embodiments are designed so that the total terminal groups are divided into two by arranging the fixed terminal holder 30 and the single movable terminal holder, the embodiments of the invention are not limited thereto, but may be such that the total terminals are divided into three groups by arranging the fixed terminal holder and two or more movable terminal holders.

(c) While the above embodiments are designed so that the fixed terminal holder 30 is molded so as to be unitized with the outer housing 21, the embodiment of the invention is not limited thereto but may be such that the outer housing is molded separately from the fixed terminal holder and that they are integrated with each other thereafter.

The invention is not limited to the embodiments described above and shown in the drawings, but may be modified in various modes within the scope and spirit of the invention.

What is claimed is:

1. A connector device for connecting first terminal group mounted with second terminal group, said connector device comprising:

a first connector housing for mounting said first terminal group therein;

a second connector housing for mounting said second terminal group therein comprising:

an outer housing:

a fixed terminal holder having a plurality of terminals and being arranged within said outer housing so as to be fixed;

a movable terminal holder having a plurality of terminals and being arranged within said outer housing so as to be movable in a direction in which said second connector housing is inserted into said first connector housing;

wherein said movable terminal holder is temporarily locked with a front end thereof being ahead of said fixed terminal holder in the connector housing insertion direction.

2. A connector device as claimed in claim 1, wherein said movable holder are temporarily locked with said fixed holder until the terminals in said movable holder are connected to the terminals of the first terminal group corresponding thereto, whereas the temporal locking is released upon connecting the movable holder to said first connecting housing.

3. A connector device as claimed in claim 1, wherein said movable holder and said fixed holder respectively include a locking means for temporarily locking said movable holder with said fixed holder, and said first connecting housing includes a locking releasing means for releasing an engagement of said locking means when said movable holder is completely coupled with said first connector housing.

4. A connector device as claimed in claim 3, wherein said locking means is made of a deformable material.

* * * * *